US009611982B2

(12) United States Patent
Armstrong

(10) Patent No.: US 9,611,982 B2
(45) Date of Patent: Apr. 4, 2017

(54) LED REPLACEMENT LIGHT ASSEMBLY WITH IMPROVED COOLING FEATURES

(71) Applicant: Daniel A. Armstrong, Simi Valley, CA (US)

(72) Inventor: Daniel A. Armstrong, Simi Valley, CA (US)

(73) Assignee: Pentair Water Pool and Spa, Inc., Cary, NC (US)

( * ) Notice: Subject to any disclaimer, the term of this patent is extended or adjusted under 35 U.S.C. 154(b) by 62 days.

(21) Appl. No.: 13/718,974

(22) Filed: Dec. 18, 2012

(65) Prior Publication Data

US 2013/0170235 A1 Jul. 4, 2013

Related U.S. Application Data

(60) Provisional application No. 61/581,275, filed on Dec. 29, 2011.

(51) Int. Cl.

| | |
|---|---|
| ***F21V 29/00*** | (2015.01) |
| ***F21K 99/00*** | (2016.01) |
| ***F21S 8/00*** | (2006.01) |
| ***F21V 29/70*** | (2015.01) |
| ***F21V 19/00*** | (2006.01) |

(Continued)

(52) U.S. Cl.

CPC ..... *F21K 9/13* (2013.01); *F21K 9/23* (2016.08); *F21S 8/00* (2013.01); *F21V 19/003* (2013.01); *F21V 23/02* (2013.01); *F21V 29/20* (2013.01); *F21V 29/507* (2015.01); *F21V 29/70* (2015.01); *F21V 19/042* (2013.01); *F21V 31/005* (2013.01); *F21W 2131/401* (2013.01); *F21Y 2101/00* (2013.01); *Y10T 29/49117* (2015.01)

(58) Field of Classification Search

CPC .... F21S 8/00; F21K 9/23; F21V 29/70; F21V 29/507; F21V 23/02; F21V 19/003; F21V 31/005; F21W 2131/401; F21Y 2101/00; Y10T 29/49117

USPC ..... 362/373, 646, 649, 650, 294, 96, 101

See application file for complete search history.

(56) References Cited

U.S. PATENT DOCUMENTS

| | | |
|---|---|---|
| 6,241,361 B1 | 6/2001 | Thrasher et al. |
| 6,869,204 B2 | 3/2005 | Morgan et al. |

(Continued)

OTHER PUBLICATIONS

First Light Lighting LLC; "Night Magic Multi-Colored LED in Ground Pool Light Installation & Operation Guide;" pp. 1-6; www.firstlighting.com.

(Continued)

*Primary Examiner* — Ali Alavi

(74) *Attorney, Agent, or Firm* — Quarles & Brady LLP

(57) ABSTRACT

Embodiments of the invention provide an LED replacement light assembly for retrofitting an incandescent light fixture that has a housing with a base. The LED replacement light assembly can include a shaft with a top portion and a lower threaded portion. The lower threaded portion can be screwed into the base. The LED replacement light assembly can also include an LED adapter, and a circuit board including a plurality of LEDs. One embodiment can include a thermally conductive disc that can engage the circuit board and the housing to conduct heat from the circuit board to the housing. A thermal interface can be positioned between the thermally conductive disc and the housing to provide enhanced conduction.

17 Claims, 7 Drawing Sheets

(51) Int. Cl.

| | |
|---|---|
| ***F21V 23/02*** | (2006.01) |
| ***F21V 29/507*** | (2015.01) |
| ***F21K 9/23*** | (2016.01) |
| *F21V 31/00* | (2006.01) |
| *F21V 19/04* | (2006.01) |
| *F21W 131/401* | (2006.01) |
| *F21Y 101/00* | (2016.01) |

(56) References Cited

U.S. PATENT DOCUMENTS

| | | | | |
|---|---|---|---|---|
| 6,949,894 | B1 | 9/2005 | Sullivan et al. | |
| 7,125,146 | B2 * | 10/2006 | Willis et al. | 362/267 |
| 7,204,602 | B2 * | 4/2007 | Archer | 362/101 |
| 7,303,301 | B2 | 12/2007 | Koren et al. | |
| 7,357,525 | B2 | 4/2008 | Doyle | |
| 7,396,139 | B2 | 7/2008 | Savage | |
| 7,410,268 | B2 | 8/2008 | Koren et al. | |
| 7,448,772 | B2 | 11/2008 | Hampton | |
| 7,473,011 | B2 | 1/2009 | Wilcox et al. | |
| 7,497,595 | B2 * | 3/2009 | Mateescu et al. | 362/284 |
| 7,520,628 | B1 | 4/2009 | Sloan et al. | |
| 7,553,039 | B2 | 6/2009 | Harris et al. | |
| 7,553,040 | B2 | 6/2009 | Boothe et al. | |
| 7,575,333 | B2 | 8/2009 | Vilarrasa | |
| 7,628,512 | B2 | 12/2009 | Netzel, Sr. et al. | |
| 7,722,216 | B2 * | 5/2010 | Amor et al. | 362/249.01 |
| 7,740,367 | B2 | 6/2010 | Koren | |
| 8,123,381 | B1 * | 2/2012 | Wray | 362/294 |
| 8,616,725 | B2 * | 12/2013 | Olsson | F21V 15/01 362/249.01 |
| 2007/0279900 | A1 | 12/2007 | Bauer et al. | |
| 2008/0112170 | A1 * | 5/2008 | Trott et al. | 362/311 |
| 2008/0186704 | A1 * | 8/2008 | Chou et al. | 362/249 |
| 2009/0027900 | A1 * | 1/2009 | Janos et al. | 362/373 |
| 2011/0050099 | A1 | 3/2011 | Matloubian et al. | |
| 2011/0211344 | A1 * | 9/2011 | Harbers et al. | 362/231 |

OTHER PUBLICATIONS

First Light LLC; "ColorGlo Multi-Color Portable Spa Light Installation & Operation Guide;" Irvine, CA USA; Jan. 29, 2010.

Grundfos; "SmartFlo SQE Constant Pressure System;" pp. 1-4; Olathe, KS USA; wwwgrundfos.com.

J&J Electronics, "PureWhite Pool Lamp Installation and Operation Guide," www.jandjpoolspa.com, Irvine, CA, pp. 1-2.

J&J Electronics, "PureWhite Pool & Spa Lamp Installation and Operation Guide," www.jandjpoolspa.com, Irvine, CA, pp. 1-2.

Nexxus Pool and Spa, "New Glaaxy Plus Pool and Spa Lights," Orlando, FL, 2010 Product Catalog, pp. 13-14.

* cited by examiner

LED REPLACEMENT LIGHT ASSEMBLY WITH IMPROVED COOLING FEATURES

CROSS REFERENCE TO RELATED APPLICATIONS

This application claims priority to U.S. Provisional Patent Application No. 61/581,275, filed Dec. 29, 2011, which is hereby incorporated by reference as if set forth in its entirety.

BACKGROUND

Many underwater lighting systems for pools, spas, and hot tubs use underwater light fixtures to provide a desired underwater lighting effect. These underwater light fixtures were typically outfitted with an incandescent light bulb. Incandescent light bulbs, however, have a number of disadvantages, such as reliability, power consumption, and limited operational life as compared to the more recent Light Emitting Diode (LED) technology. Thus, some underwater light fixtures recently being installed in underwater applications employ LEDs and previously installed incandescent light fixtures can be retrofitted with LEDs. Just as any light source does, however, LEDs emit heat during operation. Increased heat in the environment of LEDs may lead to decreased performance and operational life of the LEDs, as well as the surrounding power components. This is especially true when LEDs are used in a sealed housing that prevent direct ventilation with the surrounding environment for heat dissipation purposes, such as in underwater applications.

SUMMARY OF THE INVENTION

Some embodiments of the invention provide an LED replacement light assembly for retrofitting an incandescent light fixture for use under water. The incandescent light fixture can have a housing with a base. The LED replacement light assembly can include a shaft that has a top portion and a lower threaded portion. The lower threaded portion can be screwed into the base. The assembly can also include an LED adapter that includes circuitry for a plurality of LEDs. The LED adapter can be in electrical communication with the lower threaded portion of the shaft. The assembly can further include a circuit board having the plurality of LEDs that can be in electrical communication with the LED adapter. The assembly can also include a thermally conductive disc that can engage the circuit board. An outer surface of the thermally conductive disc can engage the housing to conduct heat from the circuit board to the housing.

In another embodiment, the invention can provide an LED replacement light assembly for retrofitting an incandescent light fixture for use under water. The incandescent light fixture can have a housing with a base. The LED replacement light assembly can include a shaft that has a top portion and a lower threaded portion. The lower threaded portion can be screwed into the base. The assembly can also include an LED adapter that includes circuitry for a plurality of LEDs. The LED adapter can be in electrical communication with the lower threaded portion of the shaft. The assembly can further include a circuit board having the plurality of LEDs that can be in electrical communication with the LED adapter. The circuit board can have a flat section to support the plurality of LEDs and a flared section being of a shape to match an inner surface of the housing.

The circuit board can engage the inner surface of the housing such that heat can be conducted from the circuit board to the housing.

The invention can also provide a method of retrofitting an incandescent light fixture that has a lens, a housing with a base, and an incandescent light screwed into the base. The method can include the step of removing the lens. The method can also include removing the incandescent light from the base of the housing. In addition, the method can include providing an LED replacement light assembly. The LED replacement light assembly can include a shaft having a top portion and a lower threaded portion, the lower threaded portion for screwing into the base. The LED replacement light assembly can also include an LED adapter including circuitry for a plurality of LEDs. The LED adapter can be in electrical communication with the lower threaded portion of the shaft. The LED replacement light assembly can also include a circuit board having the plurality of LEDs. The plurality of LEDs can be in electrical communication with the LED adapter. The method can further include installing the LED replacement light assembly into the incandescent light fixture by screwing the lower threaded portion of the shaft into the base. The LED replacement light assembly can conduct heat generated by the plurality of LEDs from the circuit board to the housing.

These and other features, aspects, and advantages of the present invention will become better understood upon consideration of the following detailed description, drawings, and appended claims.

DETAILED DESCRIPTION

Figure 1:
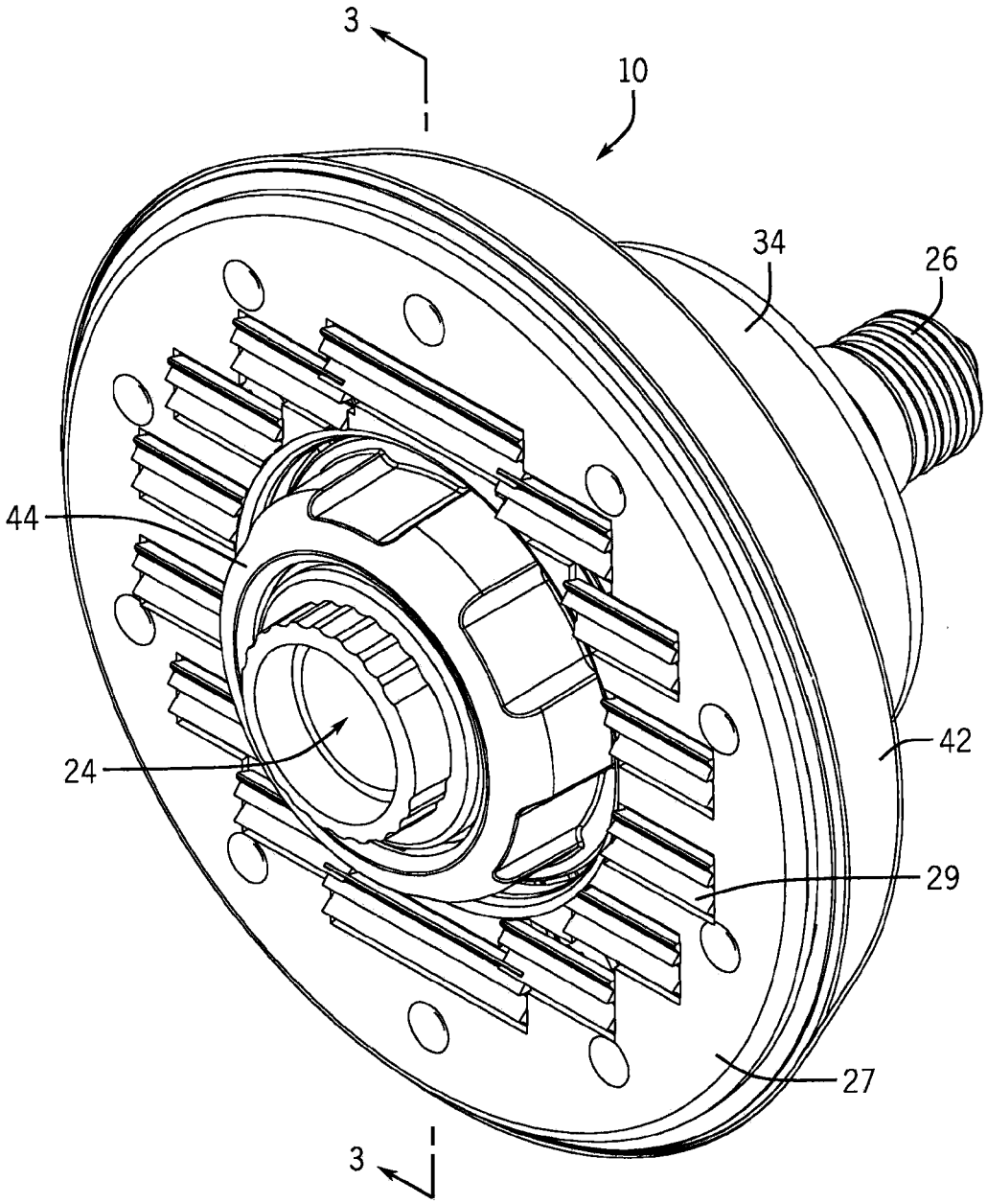
FIG. 1 is a perspective view of a first embodiment of an LED replacement light assembly.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
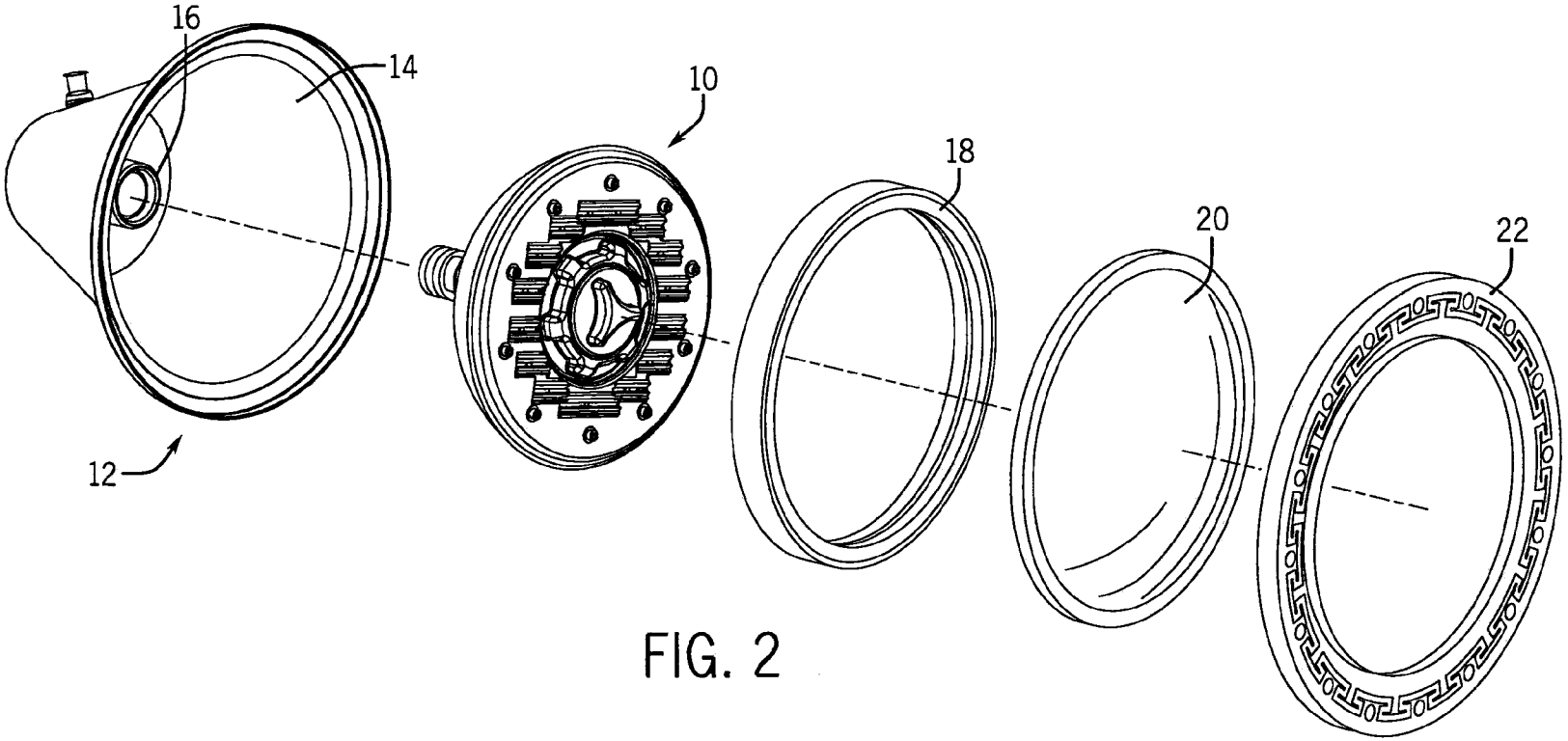
FIG. 2 is an exploded perspective view of an incandescent light fixture and the LED replacement light assembly of FIG. 1.

FIGS. 1 and 2 illustrate an LED replacement light assembly 10 that can be retrofitted into an incandescent light fixture 12 that previously included an incandescent light (not shown). The light fixture 12 can include a housing 14 and a base 16. FIG. 2 illustrates an exploded view of the LED replacement light assembly 10 removed from the housing 14. The fixture 12 can also include a gasket 18, a lens 20, and a clamp 22.

Figure 3:
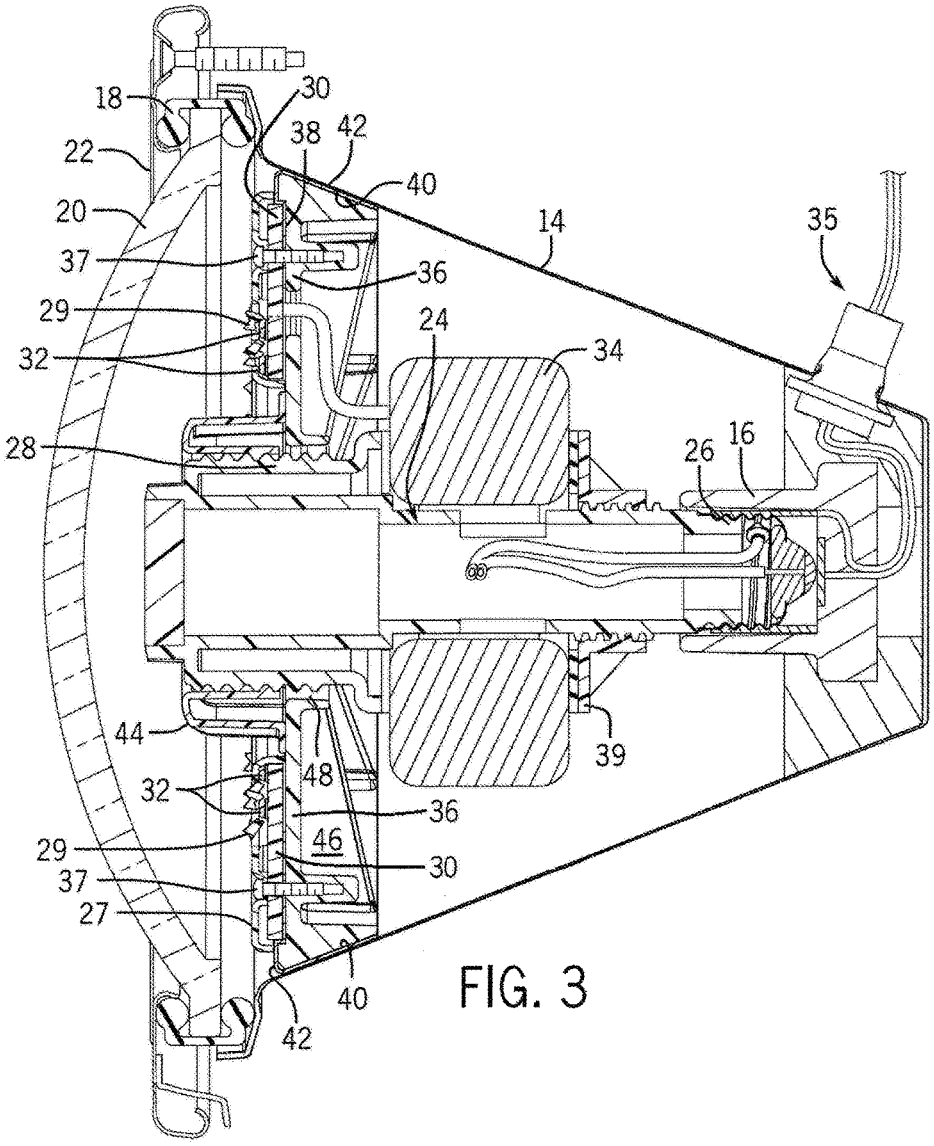
FIG. 3 is a section view 3-3 from FIG. 1 with the LED replacement light assembly installed into the light fixture of FIG. 2.

FIG. 3 illustrates the LED replacement light assembly 10 in further detail. The LED replacement light assembly 10 includes a shaft 24. The shaft 24 can include a lower threaded portion 26 and a top portion 28, which can also be threaded as illustrated in FIG. 3. The lower threaded portion 26 can be screwed into the base 16 of the housing 14. Thus, the lower threaded portion 26 can be in electrical communication with the base 16. The base 16 can be a standard Edison-style base.

The LED replacement light assembly 10 can also include a circuit board 30 that includes a plurality of LEDs 32. The LEDs 32 can be in electrical communication with an LED adapter 34 and can be covered by a cover plate 27 having slots 29 providing steering optics for the LEDs 32. The LED adapter 34 is in electrical communication with the lower threaded portion 26 of the shaft 24 and can include circuitry as known in the art to convert a power source 35 that is in electrical communication with the base 16 to the desired voltage and drive signals for the LEDs 32. For example, the LED adapter 34 can include a toroidal transformer (not shown) that can convert 120V AC to 18V AC, which is a preferable voltage for the LEDs 32. The shaft 24 can extend through the LED adapter 34 and the LED adapter 34 can include a support 39 that can be threaded on the shaft 24 to position and stabilize the LED adapter in the assembly 10.

In the embodiment illustrated in FIGS. 1-3, the LED replacement light assembly 10 includes a thermally conductive disc 36. Fasteners 37 can be used to assemble the cover plate 27 and the circuit board 30 with the thermally conductive disc 36. A top surface 38 of the thermally conductive disc 36 engages the circuit board 30 and an outer surface 40 of the thermally conductive disc 36 engages the housing 14 to conduct heat generated from the LEDs 32 to the housing 14. This conductive path allows heat to dissipate from the assembly 10 to the housing 14 and the surrounding environment of the housing 14. The thermally conductive disc 36 can also include ribs 46 that extend from an interior 48 of the disc 36 to the outer surface 40 of the disc 36. The ribs 46 can provide a more direct route for heat transfer from the LED replacement light assembly 10 to the housing 14. The thermally conductive disc 36 is preferably composed of polyphenylene sulfide, however, it is contemplated that other materials can be used to form the disc 36.

Also illustrated in FIG. 3, a thermal interface 42 can be positioned between the outer surface 40 of the thermally conductive disc 36 and the housing 14. In such a configuration, the outer surface 40 of the thermally conductive disc will thus indirectly engage the housing 14. The thermal interface 42 can also extend above the top surface 38 of the thermally conductive disc 36 to be positioned between the thermally conductive disc 36 and the circuit board 30, such that the thermal interface is frusto-conical in shape. The thermal interface 42 can be held in position by the nature of the assembly of the LED replacement light assembly 10 or by an adhesive, such as a pressure-sensitive adhesive. An adhesive could be used to adhere the thermal interface 42 to the thermally conductive disc 36 and/or the circuit board 30.

The thermal interface 42 can be soft and pliable, such that it provides increased surface contact and conduction between the top surface 38 of the thermally conductive disc 36 and the circuit board 30, which can have surface irregularities. The thermal interface 42 is preferably composed of a thermoplastic elastomer, however, the thermal interface 42 can be composed of other materials. Additionally, the thermal interface 42 can also provide increased contact between the outer surface 40 of the thermally conductive disc 36 and the housing 14. The increased engagement between the thermally conductive disc 36 and the circuit board 30 as well as the increased engagement between the thermally conductive disc 36 and the housing 14 can provide enhanced conduction from the LED replacement light assembly 10 to the housing 14.

The LED replacement light assembly 10 can also include a nut 44. The nut 44 can be a torque-limiting nut and can be threaded onto the top portion 28 of the shaft 24. As illustrated in FIG. 3, the nut 44 can force the thermal conductive disc 36 towards the base 16 such that the outer surface 40 of the thermal conductive disc 36 is forced into tighter engagement with the housing 14, as will be described in further detail below. The tightening of the nut 44 can provide enhanced conduction of the LED replacement light assembly 10 to the housing 14. The nut 44 can also provide the additional benefit of ensuring that the thermal conductive disc 36 remains in engagement with the housing 14 even if the LED replacement light assembly 10 is installed in a light fixture 12 oriented at a downward, or slightly downward angle, or in the event the fixture 12 and LED replacement light assembly 10 are subject to an external force, e.g., a swimmer's foot contacts lens 20.

The LED replacement light assembly 10 can be installed in a light fixture 12 in the following manner. First, the incandescent light bulb (not shown) is removed from the light fixture 12. To do so, the clamp 22, lens 20, and gasket 18 can be removed from the housing 14 to provide access to the incandescent light bulb.

Once the incandescent light bulb is removed, the LED replacement light assembly 10 can be installed into the fixture 12. To install the LED replacement light assembly 10, the shaft 24 can be installed into the base 16 of the housing 14 by screwing the lower threaded portion 26 of the shaft 24 into the base 16. Because the LED adapter 34, cover plate 27, circuit board 30 with the LEDs 32, thermally conductive disc 36, and thermal interface 42 can already be pre-assembled onto the shaft 24 as part of the LED replacement light assembly 10, screwing the shaft 24 into the base 16 also positions and installs those components within the fixture 12.

Thereafter, the nut 44 can be tightened on the top threaded portion 28 of the shaft 24. As briefly discussed above, tightening the nut 44 helps to ensure engagement between the outer surface 40 of the thermal conductive disc 36 with the housing 14 via the thermal interface 42. In addition, the nut 44 can also help stabilize the positioning of the LED replacement light assembly 10.

Once the LED replacement light assembly 10 is installed into the fixture 12, the gasket 18, lens 20, and clamp 22 can be re-installed in place to complete the retrofit of the incandescent light fixture 12. If desired, a new lens 20 can be used to provide enhanced optical qualities compatible with the LEDs 32. Thus, the compact and pre-assembled nature of the LED replacement light assembly 10 provides for an efficient retrofitting of an incandescent light bulb in a fixture 12.

Figure 4:
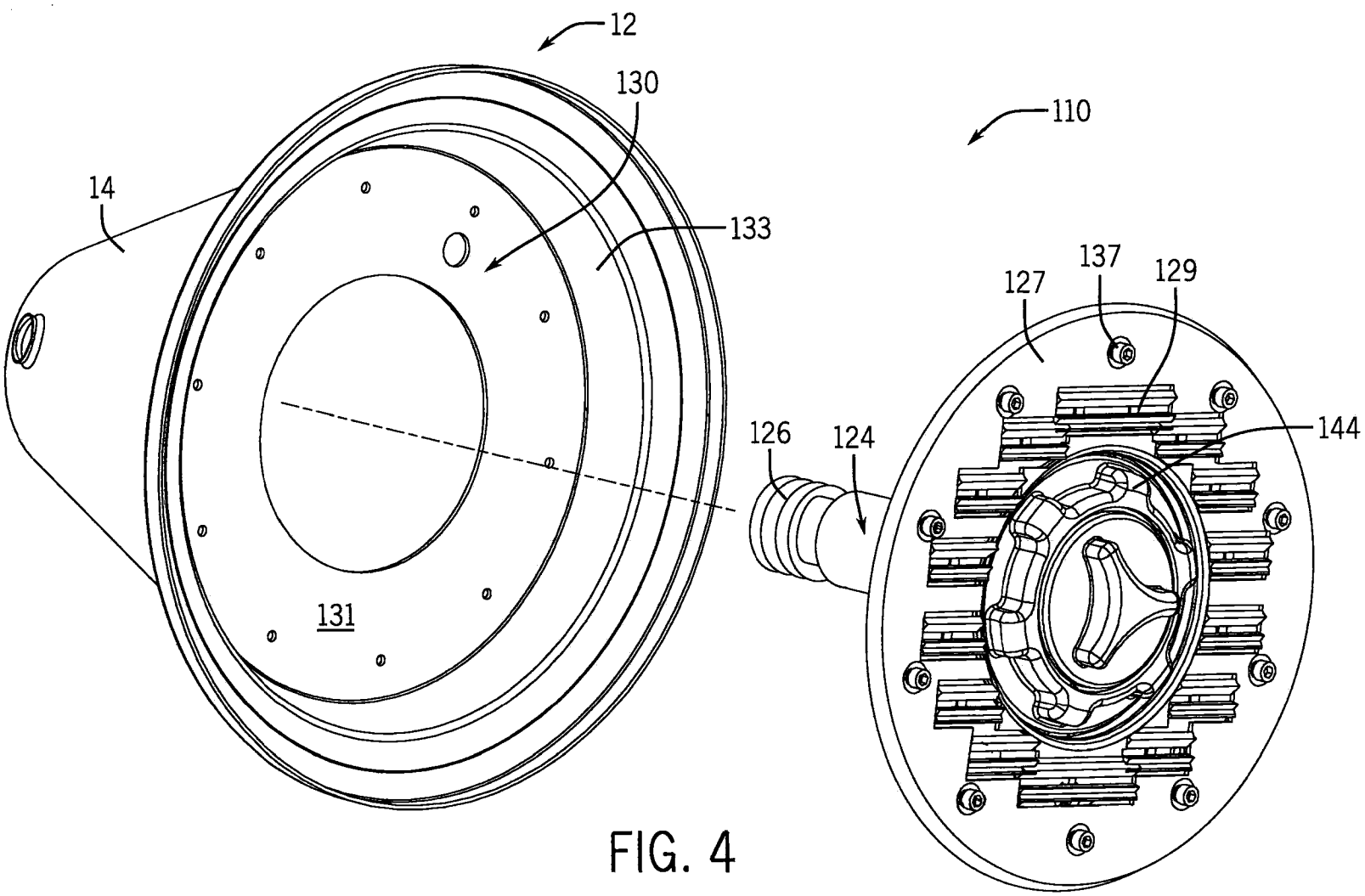
FIG. 4 is an exploded perspective view of a second embodiment of an LED replacement light assembly and a housing from an incandescent light fixture.
Figure 5:
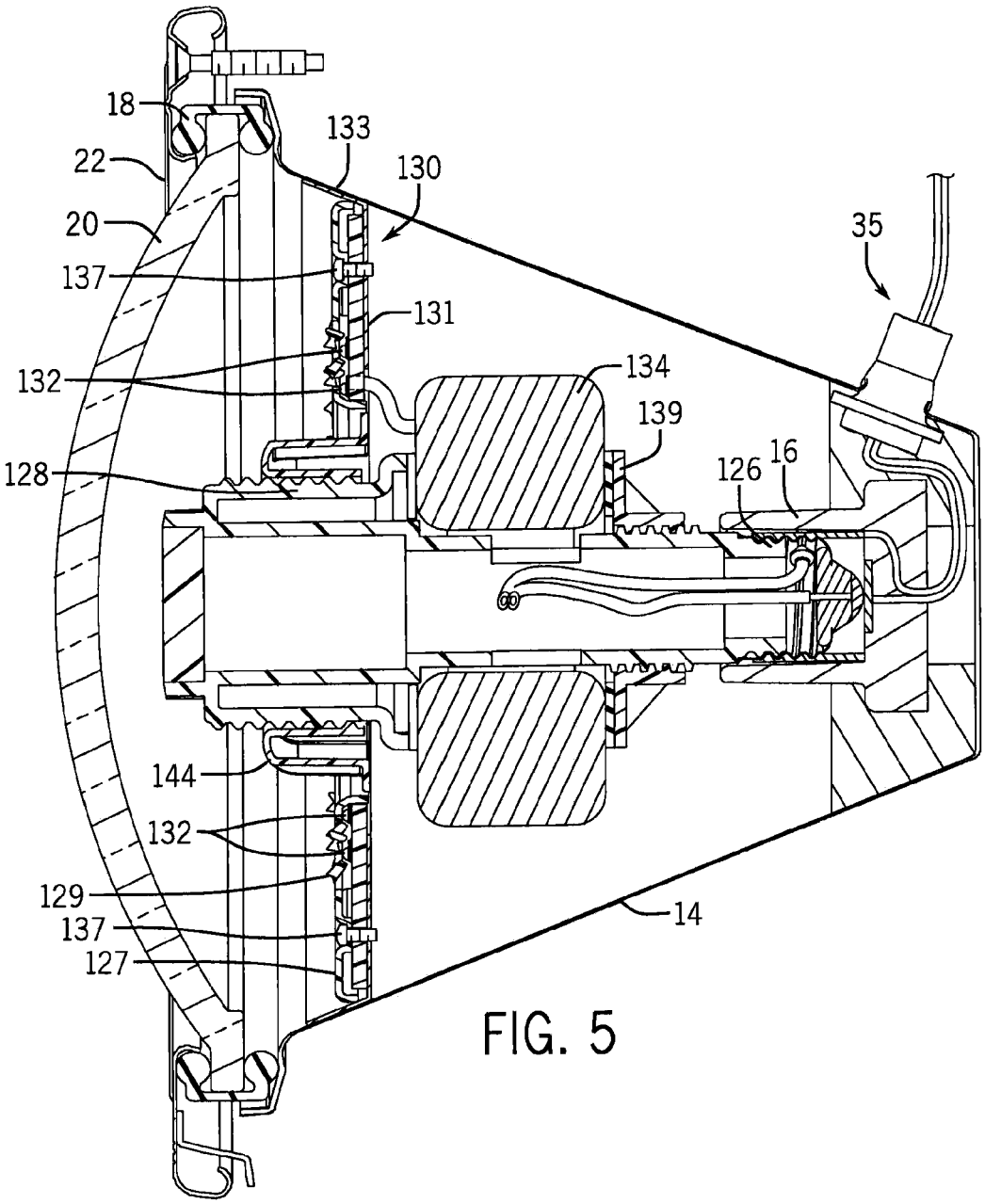
FIG. 5 is a section view of the LED replacement light assembly of FIG. 4 installed in the incandescent light fixture and also showing a gasket, lens, and clamp on the incandescent light fixture.
Figure 6:
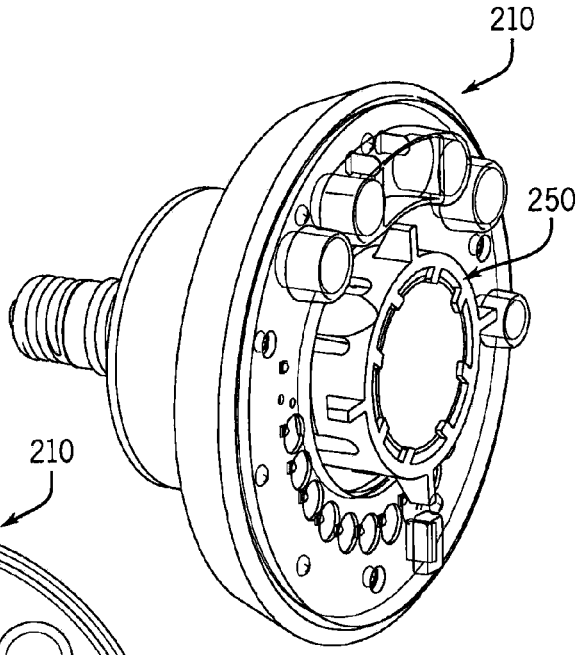
FIG. 6 is a perspective view of another embodiment of an LED replacement light assembly.
Figure 7:
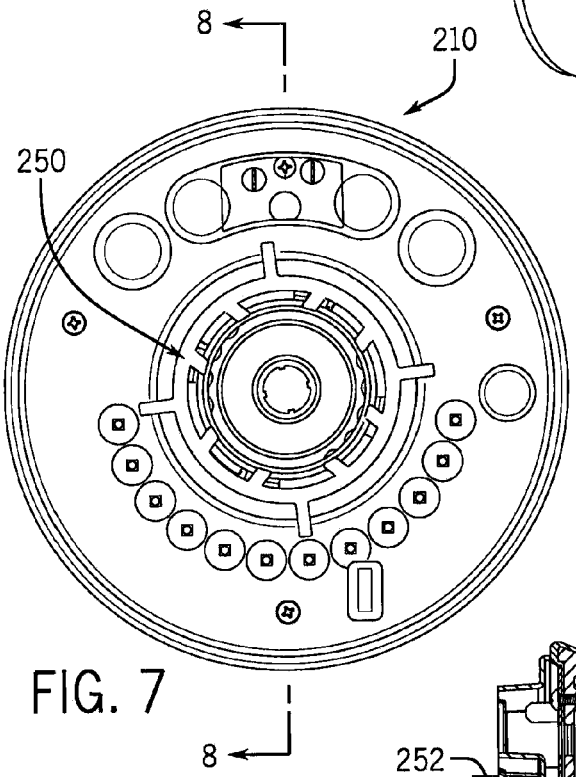
FIG. 7 is a top view of the LED replacement light assembly of FIG. 6.
Figure 8:
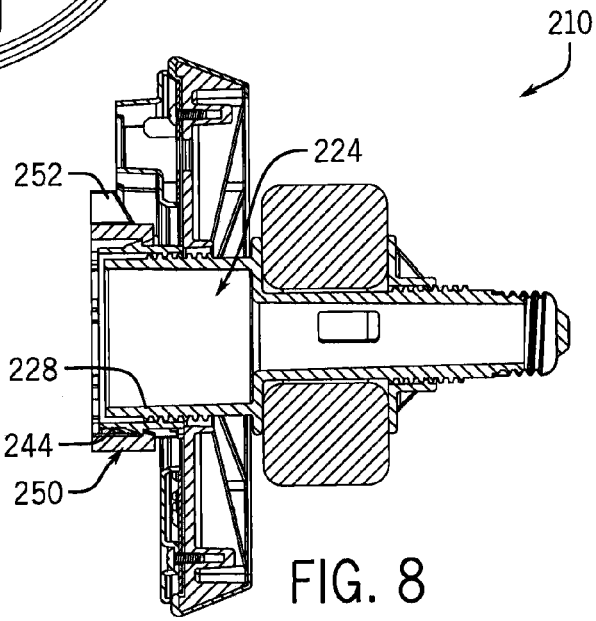
FIG. 8 is a cross-section view taken along line 8-8 from FIG. 7.
Figure 9:
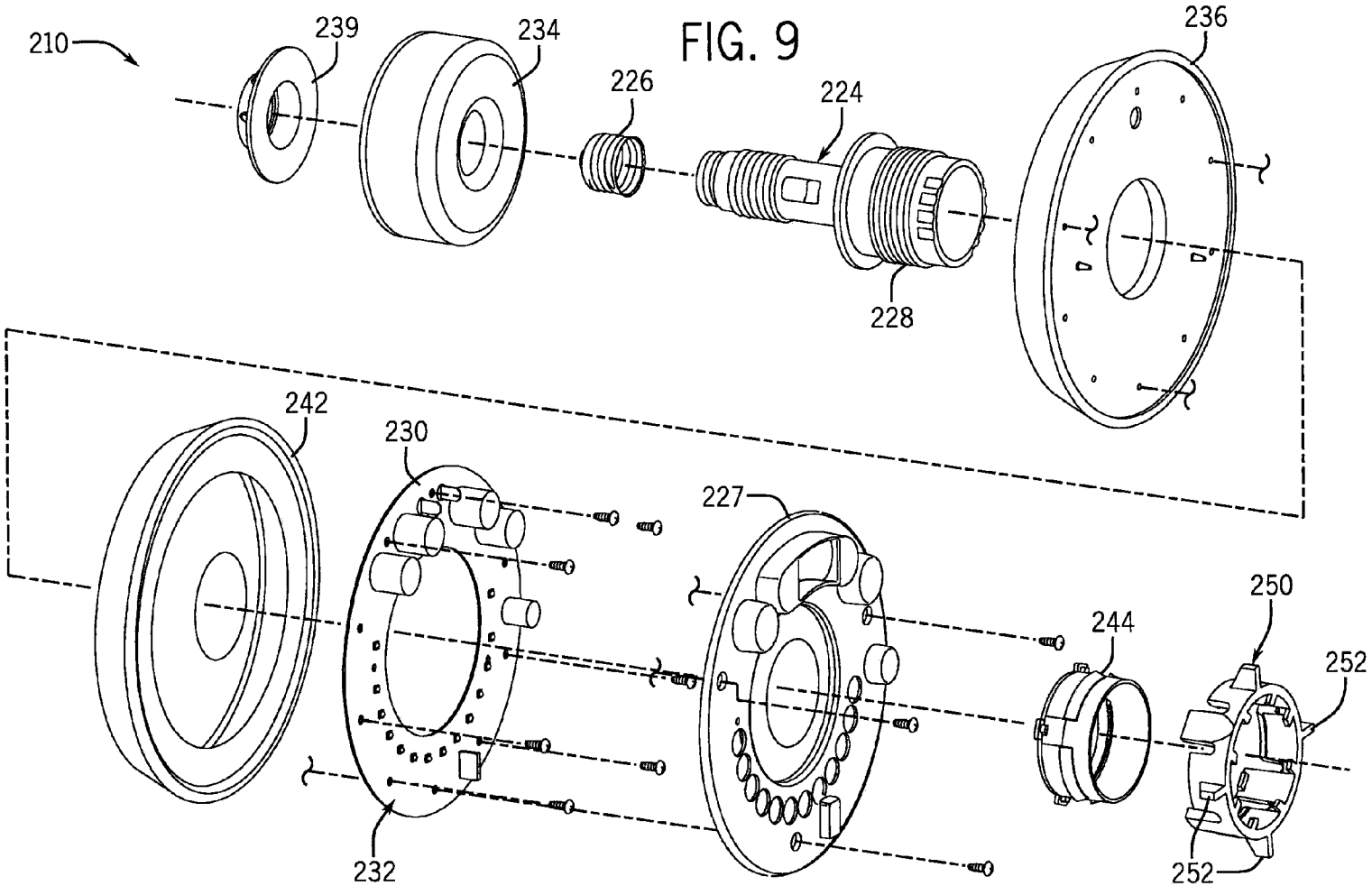
FIG. 9 is an exploded perspective view of the LED replacement light assembly of FIG. 6.

Another embodiment of an LED replacement light assembly 110 is illustrated in FIGS. 4 and 5. The LED replacement light assembly 110 can be fitted to replace an incandescent light bulb in a light fixture 12, such as that described above, that has a housing 14, a gasket 18, a lens 20, and a clamp 22.

The LED replacement light assembly 110 illustrated in FIGS. 4 and 5 includes a shaft 124. The shaft 124 can include a lower threaded portion 126 and a top portion 128, which can also be threaded as illustrated in FIG. 5. The lower threaded portion 126 can be screwed into the base 16 of the housing 14 and can be in electrical communication with the base 16, which can be a standard Edison-style base.

The LED replacement light assembly 110 can also include a flared circuit board 130 that includes a plurality of LEDs 132 covered by a cover plate 127 having slots 129. The flared circuit board 130 can be frusto-conical in shape and can include a flat section 131 that can support the LEDs 132 and a flared section 133 that can engage the housing 14. Fasteners 37 can be used to assemble the cover plate 127 to the flat section 131 of the flared circuit board 130. The flared section 133 of the circuit board 130 can be designed to match the inner surface of the housing 14 at a specified depth in the housing 14. Of course, different sizes and shapes of the flared circuit board 130 are possible such that different sizes and/or brands of housings can be retrofitted with the LED replacement light assembly 110. In this embodiment illustrated in FIGS. 4 and 5, the flared circuit board 130 can directly conduct heat generated from the LEDs 132 to the housing 14. The flat and flared sections 131, 133 of the circuit board 130 can be composed of copper, which has beneficial heat transfer properties, however, the flared circuit board 130 can be composed of other materials as well.

As described above with respect to the embodiment illustrated in FIGS. 1-3, the LEDs 132 can be in electrical communication with an LED adapter 134. The LED adapter 134 is in electrical communication with the lower threaded portion 126 of the shaft 124 and can include circuitry as known in the art to convert a power source 35 to the desired voltage and drive signals for the LEDs 132. The shaft 124 can extend through the LED adapter 134 and the LED adapter 134 can include a support 139 that can be threaded on the shaft 124 to position and stabilize the LED adapter 134 in the assembly 110.

The LED replacement light assembly 110 can also include a nut 144. The nut 144 can be threaded onto a top threaded portion 128 of the shaft 124. As illustrated in FIG. 5, the nut 144 can force the flared circuit board 130 towards the base 16 of the housing 14 such that the flared section 133 of the flared circuit board 130 is forced into tighter engagement with the housing 14. The tightening of the nut 144 can provide enhanced conduction of the LED replacement light assembly 110 to the housing 14.

Although not illustrated in FIGS. 4 and 5, the LED replacement light assembly 110 can also employ a thermal interface to enhance conduction. The pliable thermal interface can be positioned between the flared section 133 of the flared circuit board 130 and the inner surface of the housing 14 to enhance conduction between the flared circuit board 130 and the housing 14. Additionally, the LED replacement light assembly 110 can be supported by a non-conductive or conductive thermal disc to provide additional support for the flared circuit board 130 and increased thermal conduction properties. The LED replacement light assembly 110 can also be installed in a light fixture 12 in the method as described above with respect to the embodiment illustrated in FIGS. 1-3.

Another embodiment of an LED replacement light assembly 210 is shown in FIGS. 6-9. The LED replacement light assembly 210 can include many and/or all of the same components as referred to in assemblies 10, 110, however, LED replacement light assembly also includes a nut handle 250 that can engage the nut 244. The nut 244 can be threaded onto a top threaded portion 228 of the shaft 224. The nut handle 250 can assist with the tightening of the nut 244 to the shaft 224 to force the circuit board 230 (with LEDs 232) towards the base 216 to enhance conduction characteristics of the assembly 210, as discussed above. The nut handle 250 can include flanges 252 on the outer periphery of the nut handle 250 to provide an easier grip for the operator to tighten the nut 244. In addition to the components already discussed, the LED replacement light assembly 210 can also include a cover plate 227, a thermal interface 242, a thermally conductive disc 236, an LED adapter 234, a support 239, and the stem 224 can include a lower threaded portion 226.

The LED replacement light assembly 210 can also be installed in a light fixture 12 in the method as described above with respect to the embodiments illustrated in FIGS. 1-5. The step of tightening the nut 244 to the top threaded portion 228 of the shaft 224 can be partially or fully completed by placing the nut handle 250 around the nut 244 and tightening the nut handle 250.

By transferring heat to the surrounding environment via conduction, rather than solely by convection, the LED replacement light assemblies 10, 110, 210 provide for more efficient heat transfer to the surrounding environment. This may help increase performance characteristics of the LEDs 32, 132, 232 as well as various power components, such as, but not limited to, the LED adapter 34, 134, 234. Additionally, the improved heat transfer characteristics of the LED replacement light assembly 10, 110, 210 can provide for increased operational life of the LEDs 32, 132, 232.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto.

The invention claimed is:

1. An LED light assembly for retrofitting an incandescent light fixture for use under water, the incandescent light fixture having a housing with a base, the LED light assembly comprising;

a shaft including a top threaded portion and a lower threaded portion, the lower threaded portion configured to screw into the base to provide electrical power to the LED light assembly;

an LED adapter including circuitry for a plurality of LEDs, the LED adapter in electrical communication with the lower threaded portion of the shaft;

a circuit board including the phurality of LEDs, the plurality of LEDs in electrical communication with the LED adapter;

a thermally conductive disc including a thermally conductive path for conducting heat from the circuit board to the housing, the thermally conductive path including at least a top surface of the thermally conductive disc engaging the circuit board and an outer surface of the thermally conductive disc configured to engage the housing, wherein the top threaded portion of the shaft extends through the thermally conductive disc; and a nut in threaded engagement with the top threaded portion of the shaft, wherein tightening the nut forces the thermally conductive disc toward the base and forces the outer surface of the thermally conductive disc into tighter engagement with the housing.

2. The LED light assembly of claim 1, wherein the outer surface of the thermally conductive disc is frusto-conical in shape extending from the top surface of the thermally conductive disc towards the base of the housing to increase a surface area of engagement between the thermally conductive disc and the housing in order to enhance conduction between the thermally conductive disc and the housing.

3. The LED light assembly of claim 1, further comprising:

a thermal interface provided between the thermally conductive disc and the housing to allow the thermally conductive disc to indirectly engage the housing and to conduct heat from the circuit board to the housing through the thermal interface.

4. The LED light assembly of claim 3, wherein the thermal interface is further provided between the top surface of the thermally conductive disc and the circuit board.

5. The LED light assembly of claim 3, wherein the thermal interface is comprised of a thermoplastic elastomer.

6. The LED light assembly of claim 1, wherein the LED adapter is supported by the shaft and the shaft extends through the LED adapter.

7. The LED light assembly of claim 1, wherein the thermally conductive disc is comprised of polyphenylene sulfide.

8. The LED light assembly of claim 1, wherein the thermally conductive disc includes a plurality of ribs extending from an interior of the thermally conductive disc to the outer surface of the thermally conductive disc.

9. An LED light assembly for retrofit ins an incandescent light fixture for use under water, the incandescent light fixture having a housing with a base, the LED light assembly comprising:

a shaft including a top threaded portion and a lower threaded portion, the lower threaded portion for screwing into the base to provide electrical power to the LED light assembly;

an LED adapter including circuitry for a plurality of LEDs, the LED adapter in electrical communication with the lower threaded portion of the shaft;

a circuit board including the plurality of LEDs, he plurality of LEDs in electrical communication with the LED adapter, the circuit board having a flat section to support the plurality of LEDs and a flared section being of a shape to match an inner surface of the housing and to engage the inner surface of the housing such that heat is conducted from the circuit board to the housing, wherein the top threaded portion of the shaft extends through the circuit board;

a thermally conductive disc including a thermally conductive path for conducting heat from the circuit board to the housing, wherein the top threaded portion of the shaft extends through the thermally conductive disc; and a nut in threaded engagement with the top portion of the shaft, wherein tightening the nut forces the circuit board toward the base and forces the outer surface of the circuit board to engage the housing.

10. The LED light assembly of claim 9, further comprising:

a thermal interface provided between the flared section of the circuit board and the housing such that the circuit board indirectly engages the housing and conducts heat to the housing through the thermal interface.

11. The LED light assembly of claim 10, wherein the thermal interface is comprised of a thermoplastic elastomer.

12. The LED light assembly of claim 9, wherein the LED adapter is supported by the shaft and the shaft extends through the LED adapter.

13. A method of retrofitting an incandescent light fixture, the incandescent light fixture having a lens, a housing with a base, and being configured to receive an incandescent light screwed into the base, the method comprising the steps of:

providing an LED light assembly that comprise:

a shaft including a top portion and a lower threaded portion, the lower threaded portion for screwing into the base to provide electrical power to the LED light;

an LED adapter including circuitry for a plurality of LEDs, the LED adapter in electrical communication with the lower threaded portion of the shaft, wherein the LED adapter is supported by the shaft, the shaft extends through the LED adapter, and the LED adapter includes a support hat is threaded on the shaft to stabilize the LED adapter;

a circuit board including the plurality of LEDs, the plurality of LEDs in electrical communication with the LED adapter; and a thermally conductive d sc including a thermally conductive path for conducting heat from the circuit board to the housing, the thermally conductive path including at least a top surface of the thermally conductive disc engaging the circuit board and an outer surface of the thermally conductive disc configured to engage the housing;

installing the LED light assembly into the incandescent light fixture by screwing the lower threaded portion of the shaft into the base; and installing the lens onto the incandescent light fixture.

14. The method of claim 13, wherein the LED light assembly further comprises a thermal interface on the outer surface of the thermally conductive disc, the method further comprising installing the LED light assembly into the incandescent light fixture such that the thermal interface engages the housing to allow the thermally conductive disc to indirectly engage the housing and to conduct heat from the circuit board o the housing through the thermal interface.

15. The method of claim 13, wherein the LED light assembly further comprises a thermal interface positioned between the circuit board and the top surface of the thermally conductive disc.

16. The method of claim 13, wherein the shaft includes a top threaded portion and the LED light assembly further comprises a nut; the method further comprising the step of:

tightening the nut on the top portion of the shaft to force the circuit board to engage the housing and provide thermal conduction between the circuit board and the housing.

17. The method of claim 13, wherein installing the LED light assembly into the incandescent light fixture further comprises engaging the outer surface of the thermally conductive disc with the housing.

* * * * *